United States Patent [19]

Boebel et al.

[11] 4,362,910

[45] Dec. 7, 1982

[54] ELECTRICAL SWITCH

[75] Inventors: Theodore D. Boebel, Bedford; William B. Walkup, Southboro; Edward B. Mitchell, Belmont, all of Mass.

[73] Assignee: Ark-Les Corporation, Watertown, Mass.

[21] Appl. No.: 221,719

[22] Filed: Dec. 31, 1980

[51] Int. Cl.[3] ..... H01H 5/18; H01H 9/16; H01H 9/26

[52] U.S. Cl. ..... 200/5 EA; 200/67 D; 200/302; 200/308

[58] Field of Search ..... 200/67 D, 72 R, 302, 200/308, 5 EA, 159 A, 67 B, 67 PK, 67 A

[56] References Cited

U.S. PATENT DOCUMENTS

| | | | |
|---|---|---|---|
| 1,311,019 | 7/1919 | Smith | 200/159 R |
| 3,250,882 | 5/1966 | Campbell et al. | 200/157 |
| 3,510,606 | 5/1970 | Abe et al. | 200/67 D |
| 3,513,274 | 5/1970 | Jullien-Davin | 200/67 R |
| 3,548,131 | 12/1970 | Piber | 200/67 D |
| 3,578,926 | 5/1971 | Obermann | 200/67 D |
| 3,796,844 | 3/1974 | Osika | 200/5 E |
| 3,916,135 | 10/1975 | Holden et al. | 200/339 |
| 3,941,953 | 3/1976 | Misson et al. | 200/5 R |
| 3,952,175 | 4/1976 | Golbeck et al. | 200/5 EA |
| 3,965,316 | 6/1976 | Olson | 200/67 D |
| 3,995,129 | 11/1976 | Michalski | 200/67 B |
| 4,045,632 | 8/1977 | Pierrot | 200/67 D |
| 4,059,737 | 11/1977 | Gergand | 200/302 |
| 4,095,066 | 6/1978 | Harris | 200/67 A |
| 4,121,069 | 10/1978 | Long | 200/67 A |
| 4,130,747 | 12/1978 | Resh | 200/67 D |

FOREIGN PATENT DOCUMENTS

| | | | |
|---|---|---|---|
| 1066258 | 10/1959 | Fed. Rep. of Germany | 200/67 B |
| 597592 | 8/1959 | Italy | 200/308 |
| 1189971 | 4/1970 | United Kingdom | 200/67 D |

*Primary Examiner*—John W. Shepperd

[57] ABSTRACT

An electrical switch with low profile and small button motion has a button close to a pivot and includes a ring like structure with bearing areas to open and close contacts. The actuating button is situated in an aperture and covered with a flexible membrane which seals the switch, prevents entry of dirt and gives an indication of the switch.

10 Claims, 5 Drawing Figures

FIG 1
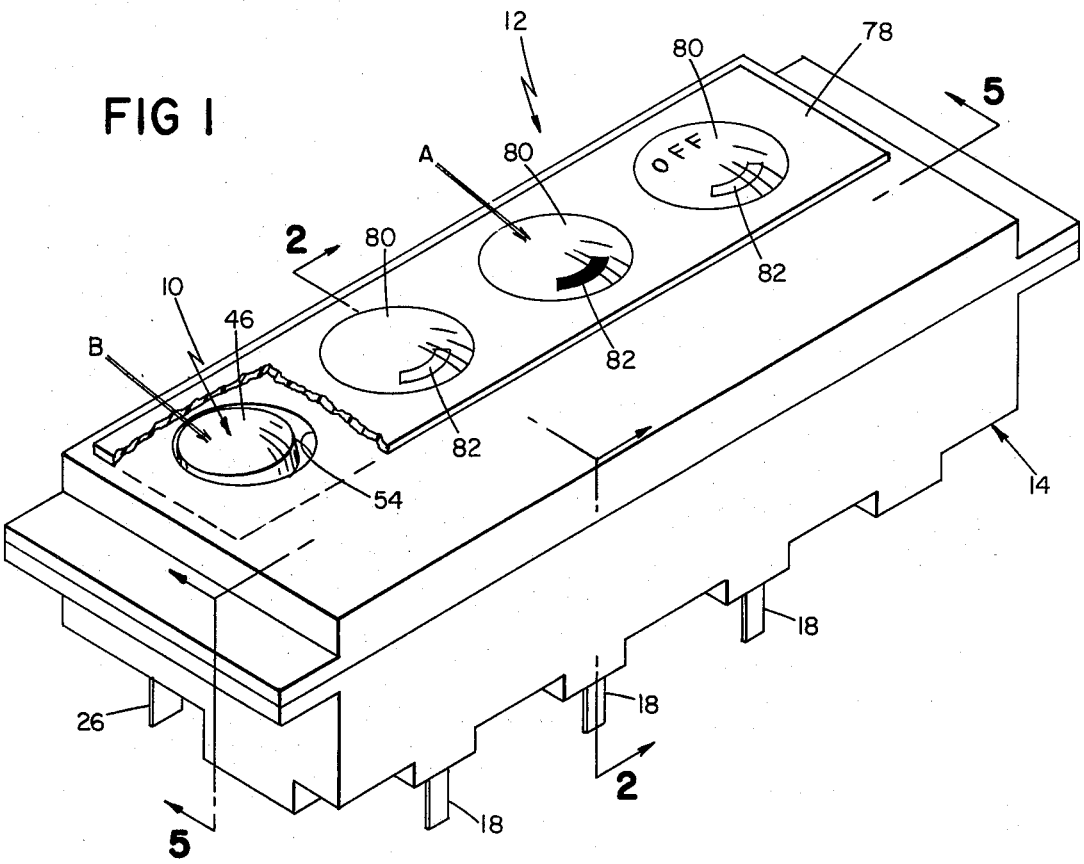
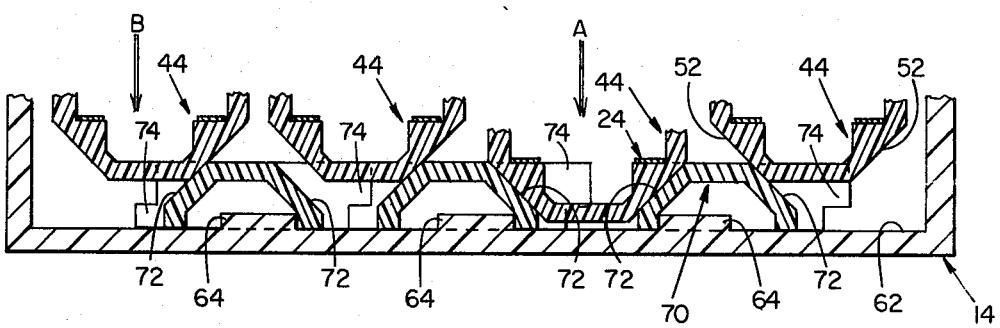
FIG 5

FIG 4
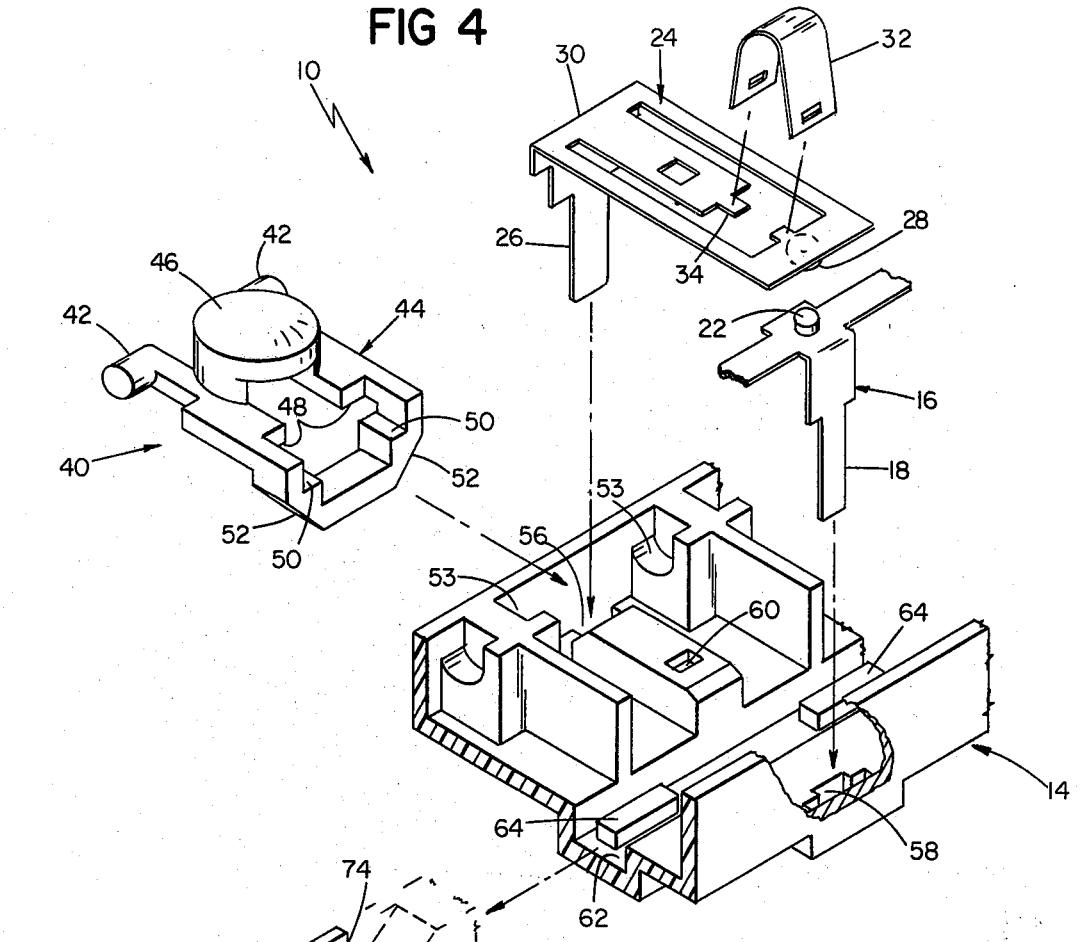
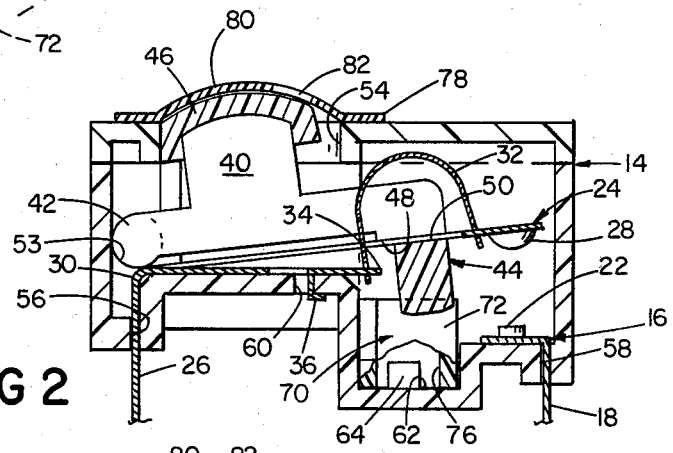
FIG 2
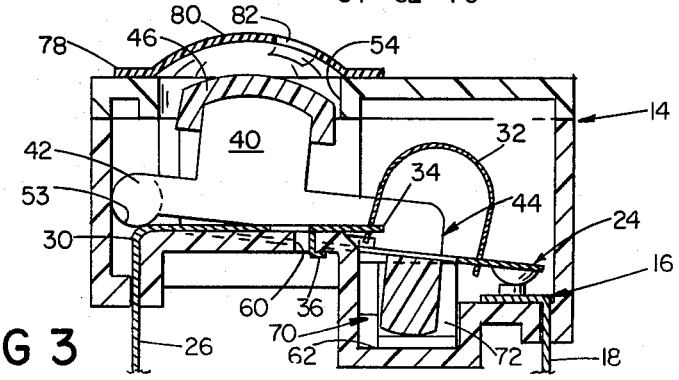
FIG 3

ELECTRICAL SWITCH

BACKGROUND OF THE INVENTION

This invention relates to electrical switches.

Switches with low profile and low travel for the actuating button have been used notably for pocket calculators and the like where they are called on to switch the low voltages and currents characteristic of electronic circuitry. Such switches are not suitable, however, for direct switching of the higher currents and voltages which are commonly employed for household appliances and industrial equipment. Some form of amplification may be used in conjunction with such switches to adapt them to higher levels of current and voltage, but with considerable increased cost in the overall switch equipment.

SUMMARY OF THE INVENTION

The invention features an electrical switch for switching household appliances and the like having a supporting case of insulating material, a contacting post affixed to the case and providing means for connecting to electrical circuitry and a contact area for making contact, a contacting element of generally elongated shape attached to the case and providing means near a first end for connecting to electrical circuitry and contacting area for making contact near its second end, the element having a flexing region near its first end permitting the contacting area to move into contact with the contact area of the post or away therefrom, a biasing spring attached to the contacting element and directly or indirectly to the case and arranged to bias the position of the contacting area into contact with the contact area when the contacting element is in a first portion of its range of rotation around its flexing region and to bias the contacting area away from the contact area when the contacting element is in a second portion of its range, and an actuating structure of non-conductive material having a pivot portion, a finger button, the contacting element around its pivot from the second portion of its range to the first portion of its range, a turn-off pressure surface for receiving a pressure to open the contact area and the contacting area, a turn-off bearing portion for driving the element from the first portion of its range to the second portion, the pivot portion being positioned adjacent to the flexing region of the contacting element, the turn-on and turn-off bearing portions being positioned near the contacting area, and the finger button being situated intermediate between the pivot and the contacting area. The invention may additionally feature a pivot at least twice as far from the contacting area as from the finger tip portion, a finger button situated in an aperture in the case the aperture being sealed with a flexible and resilient membrane passing over the finger button to permit pressure to be applied to the finger button through the membrane while sealing the interior of the case from entry of foreign material, a transparent window over each button, a finger button having a distinctive color and positioned so that it touches the window and displays its distinctive color through the window when the switch is open but is spaced from the window so that its distinctive color is not displayed when the switch is closed, thus giving a visible indication of the state of the switch, a finger button moving less than 1.5 mm while the contacting area moves enough to establish a gap safely breaking a 220 V, 15 amp circuit, an actuating structure having a ring like structure which is positioned to encircle the contacting element, and a turn-off bearing portion positioned adjacent to said contacting area of said contacting element.

The invention may also feature a gang of switches including between each pair of adjacent switches a slide element moving in a raceway of the case and having surfaces bearing on the release pressure areas of adjacent actuating structures and shaped and arranged so that the movement of one of the actuating structures to close its associated contact forces a slide element against the release pressure area of the actuating structure of any closed switch causing it to open. The slide elements may further include stepped end surfaces each engaging a reciprocal surface on the adjacent slide element and stabilizing the retention of the slide elements in said raceway.

BRIEF DESCRIPTION OF THE DRAWINGS

FIG. 1 shows in perspective a gang of switches according to the invention;

FIGS. 2 and 3 show in open and closed positions respectively a cross sectional view of one of the switches of FIG. 1, the section being taken on the plane 2—2;

FIG. 4 is an exploded view showing details of some of the components of a switch of FIG. 1; and FIG. 5 shows a portion of a sectional view of the gang of switches of FIG. 1 showing details of the construction.

DESCRIPTION OF EMBODIMENT

Referring to the Figures, switch 10 according to the invention is assembled in a gang 12 of similar switches within supporting case 14 of insulating material. Any one of the switches may be "on" at a given time. An "off" position may be obtained by leaving one switch unconnected. Switch 10 includes contacting post 16 affixed to case 14 with lug 18 for connecting to electrical circuitry, and with contact area 22 for making contact. Attached to case 14 is contacting element 24 made of conductive material and of a generally elongated shape with lug 26 for attachment of electrical circuitry at one end, with contacting area 28 near its second end and a flexing region 30. Biasing spring 32 is attached near one end to case 14 through nib 34 and locking tab 36. Near its other end, spring 32 engages contacting element 24 near contacting area 28.

Actuating structure 40, made of non-conducting material, includes pivot portion 42 positioned adjacent to flexing region 30, and generally ring like structure 44 which encircles contacting element 24 and includes finger button 46, turn-on bearing portions 48, turn-off bearing portions 50, and release pressure surfaces 52.

Case 14, includes interior surfaces 53 for capturing pivot 42, aperture 54 in which finger tip portion 46 is situated, hole 56 through which lug 26 protudes, hole 58 through which lug 18 protrudes, and hole 60 through which locking tab 36 extends. Case 14 further includes raceway 62 with guide blocks 64 therein. Slide element 70 made of insulating material includes bearing surfaces 72, stepped ends 74, and cavity 76 which fits over an associated guide block 64 while slide element 70 rests in raceway 62.

Elastic membrane 78 fits over apertures 54, covering finger buttons 46 and sealed around its periphery to case 14 to prevent entry of foreign material such as water or dirt. A shallow resilient bubble 80 in membrane 78 is positioned over each of apertures 54 covering the associated finger button 46. Each bubble has a window 82 in part of its surface. When, as shown particularly in FIG. 2, the switch is open, button 46 touches the bottom surface of the window, but, as shown in FIG. 3, when the switch is closed the button is depressed somewhat below the lower surface of the window. The appearance of the window when the button is touching it is considerably different from that when the button is depressed so that a visual indication is given as to which of the several switches in the gang is closed. The effect may be advantageously enhanced by making the button and the bubble of contrasting colors.

The operation of the gang of switches is as follows supposing that initially the switch marked A is in the "on" position conforming to the situation shown in FIGS. 1 and 5. Switch A would then be as shown in FIG. 3 with the spring holding the contact closed while all other switches of the gang would be as shown in FIG. 2 with the associated springs holding the gap open. When an operator then pushes down with his finger on a bubble of a switch other than "A", say "B" second to the left of "A" as shown in FIGS. 1 and 5, the membrane flexes under the pressure and the underlying button 46 is pushed downward causing actuating structure 40 to rotate about pivot portion 42 and press its bearing surface 52 against engaged bearing surface 72 of slide element 70. The force on between the engaged bearing surfaces forces all the sliding elements that lie between switch B and switch A to move toward switch A. (See particularly FIG. 5). This motion thrusts bearing surface 72 of the adjacent sliding element against bearing surface 52 of switch A and generates an upward force on actuating element 40 of switch A. This upward force is communicated to contacting element 24 at turn-off bearing portion 50 and causes contacting area 28 to separate from contact area 22 and open switch A. The proximity of turn-off bearing portion 50 to the contacting area permits a vigorous application of a circuit breaking force to break any welds with minimum attenuation by deformation of the contacting element. During this initial range of movement of the finger button the bias of the spring opposes the force of the applied finger, but a point is reached (when the two ends of the spring are lined up with the flexing region) when the contacting element enters another range of rotation wherein the spring bias aids the finger force and drives the contacting area 28 of switch B rapidly down and against the contact area 22 while in switch A the contacting element has moved into the range where the spring acts to open the switch. The total motion of the button is 1.5 mm, while the gap opens to over 3 mm—a distance satisfactory for switching 220 V, 15 amp circuits.

After the opening of switch A and the closing of switch B has concluded, the finger is normally removed and the depressed bubble of switch B snaps back leaving a space between the membrane and the button giving the visual indication of the actuated switch as described earlier.

The invention as described above provides a switch which is effective in directly switching currents and voltages in the range commonly used in household appliances and light industrial equipment. It presents an attractive appearance with low button profile and travel and a smooth surface easy to clean and with no slots around the buttons in which dirt can collect. The switch has high reliability because it passes the current through flexing areas rather than pivots, because it provides a strong force for initial breaking of contact and because it breaks a circuit relatively slowly while making a circuit more rapidly. And finally the switch is low in cost.

What is claimed is:

1. An electrical switch for switching household appliances and the like comprising in combination a supporting case of insulating material, a contacting post affixed to said case and providing means for connecting to electrical circuitry and a contact area for making contact, a contacting element of generally elongated shape attached to said case and providing means near a first end for connecting to electrical circuitry and contacting area for making contact near its second end, said element having a flexing region near its first end permitting said contacting area to move into contact with the contact area of said post or away therefrom, a biasing spring attached to said contacting element and directly or indirectly to said case and arranged to bias the position of said contacting area into contact with said contact area when said contacting element is in a first portion of its range of rotation around its flexing region and to bias said contacting area away from said contact area when said contacting element is in a second portion of its range, an actuating structure of non-conductive material having a pivot portion, a finger button for receiving pressure from a finger tip, a turn-on bearing portion for bearing on and driving, when pressure from a finger is applied to said finger button, said contacting element around its pivot from said second portion of its range to said first portion of its range, a turn-off pressure surface for receiving a pressure to open said contact area and said contacting area, a turn-off bearing portion for driving said element, when pressure is applied to said turn-off pressure surface, from said first portion of its range to said second portion, said pivot portion being positioned adjacent to the flexing region of said contacting element, said turn-on and turn-off bearing portions being positioned nearer said contacting area than said finger portion, said finger button being situated intermediate between said pivot and said contacting area, said turn-off pressure receiving surface, said finger button, and said pivot being positioned such that as projected on said contacting element the finger button and the turn-off pressure receiving surface lie on the same side of the pivot.

2. Apparatus as claimed in claim 1 wherein said pivot is at least twice as far from said contacting area as from said finger tip portion.

3. Apparatus as claimed in claim 2 wherein said turn off bearing portion is positioned adjacent to said contacting area of said contacting element.

4. Apparatus as claimed in claim 2 wherein said actuating structure includes a ring like structure which is positioned to encircle said contacting element

5. Apparatus as claimed in claim 1 wherein the finger button of said actuating structure moves less than 1.5 mm and said contacting area moves enough to establish a gap safely breaking a 220 V, 15 amp circuit.

6. Apparatus as claimed in claim 1 wherein said finger button is situated in an aperture in said case and said aperture is sealed with a flexible membrane passing over said finger button to permit pressure to be applied to said finger button through said membrane while sealing the interior of said case from entry of foreign material.

7. A gang of serially adjacent switches for switching household appliances and the like, each switch comprising in combination a supporting case of insulating material, a contacting post affixed to said case and providing means for connecting to electrical circuitry and a contact area for making contact, a contacting element of generally elongated shape attached to said case and providing means near a first end for connecting to electrical circuitry and contacting area for making contact near its second end, said element having a flexing region near its first end permitting said contacting area to move into contact with the contact area of said post or away therefrom, a biasing spring attached to said contacting element and directly or indirectly to said case and arranged to bias the position of said contacting area into contact with said contact area when said contacting element is in a first portion of its range of rotation around its flexing region and to bias said contacting area away from said contact area when said contacting element is in a second portion of its range, an actuating structure of non-conductive material having a pivot portion, a finger button for receiving pressure from a finger tip, a turn-on bearing portion for driving, when pressure from a finger is applied to said finger button, said contacting element around its pivot from said second portion of its range to said first portion of its range, a turn-off pressure surface for receiving a pressure to open said contact area and said contacting area, a turn-off bearing portion for driving said element from said first portion of its range to said second portion, said pivot portion being positioned adjacent to the flexing region of said contacting element, said turn-on and turn-off bearing portions being positioned near said contacting area, and said finger button being situated intermediate between said pivot and said contacting area, including between adjacent switches of said gang a slide element moving in a raceway of said case and having surfaces bearing on said release pressure areas of actuating structures of adjacent switches of said gang and shaped and arranged so that the movement of one of said actuating structures to close its associated contact forces a slide element against the release pressure area of the actuating structure of any closed switch of said gang causing it to open.

8. Apparatus as claimed in claim 7 wherein said slide elements include stepped end surfaces each engaging a reciprocal surface on the adjacent slide element and stabilizing the retention of the slide elements in said raceway.

9. Apparatus as claimed in claim 7 wherein a single flexible membrane covers all of the apertures.

10. An electrical switch for switching household appliances and the like comprising in combination a supporting case of insulating material, a contacting post affixed to said case and providing means for connecting to electrical circuitry and a contact area for making contact, a contacting element of generally elongated shape attached to said case and providing means near a first end for connecting to electrical circuitry and contacting area for making contact near its second end, said element having a flexing region near its first end permitting said contacting are to move into contact with the contact area of said post or away therefrom, a biasing spring attached to said contacting element and directly or indirectly to said case and arranged to bias the position of said contacting area into contact with said contact area when said contacting element is in a first portion of its range of rotation around its flexing region and to bias said contacting area away from said contact area when said contacting element is in a second portion of its range, an actuating structure of non-conductive material having a pivot portion, a finger button for receiving pressure from a finger tip, a turn-on bearing portion for driving, when pressure from a finger is applied to said finger button, said contacting element around its pivot from said second portion of its range to said first portion of its range, a turn-off pressure surface for receiving a pressure to open said contact area and said contacting area, a turn-off bearing portion for driving said element from said first portion of its range to said second portion, said pivot portion being positioned adjacent to the flexing region of said contacting element, said turn-on and turn-off bearing portions being positioned near said contacting area, and said finger button being situated intermediate between said pivot and said contacting area, wherein said finger button is situated in an aperture in said case and said aperture is sealed with a flexible membrane passing over said finger button to permit pressure to be applied to said finger button through said membrane while sealing the interior of said case from entry of foreign material, wherein said membrane is resilient, returning to its upward position when not pressed, and has a transparent window above the finger tip portion of said actuating structure, and said finger button is given a distinctive color and positioned so that it touches said window and displays its distinctive color though said window when said switch is open but is spaced from said window so that its distinctive color is not displayed when said switch is closed, thus giving a visible indication of the state of the switch.

* * * * *